United States Patent [19]

Franzmann

[11] 4,317,403

[45] Mar. 2, 1982

[54] DEVICE FOR CONTINUOUS PITCH VARIATION OF STRINGED INSTRUMENTS

[76] Inventor: Rainer Franzmann, Rehhagweg 9, 7800 Freiburg, Fed. Rep. of Germany

[21] Appl. No.: 183,694

[22] Filed: Sep. 3, 1980

[30] Foreign Application Priority Data

Mar. 6, 1979 [DE] Fed. Rep. of Germany ..... 2908766

[51] Int. Cl.[3] ..... G10D 3/00

[52] U.S. Cl. ..... 84/313

[58] Field of Search ..... 84/313

[56] References Cited

U.S. PATENT DOCUMENTS 3,056,329 10/1962 Butts ..... 84/313

3,466,962 9/1969 Cole ..... 84/313

*Primary Examiner*—Lawrence R. Franklin

*Attorney, Agent, or Firm*—Stonebraker, Shepard & Stephens

[57] ABSTRACT

A device for continuous pitch variation of a stringed musial instrument. The neck portion of the instrument is movable relative to the body, to vary the tension on the strings, thereby to vary the pitch during playing. Locking means is provided for locking these parts against movement when no variation in pitch is desired, and for quickly unlocking the parts to allow movement when the variation is desired. The locking arrangement is responsive to pressure exerted by the playing arm of the player, exerted on a control member on the body of the instrument. Locking is accomplished by driving a rotary locking wheel into a tapered locking notch. There is provision for maintaining the lock in an effective locking position when no movement would be desired, as for example during transportation of the instrument.

9 Claims, 3 Drawing Figures

FIG. 1
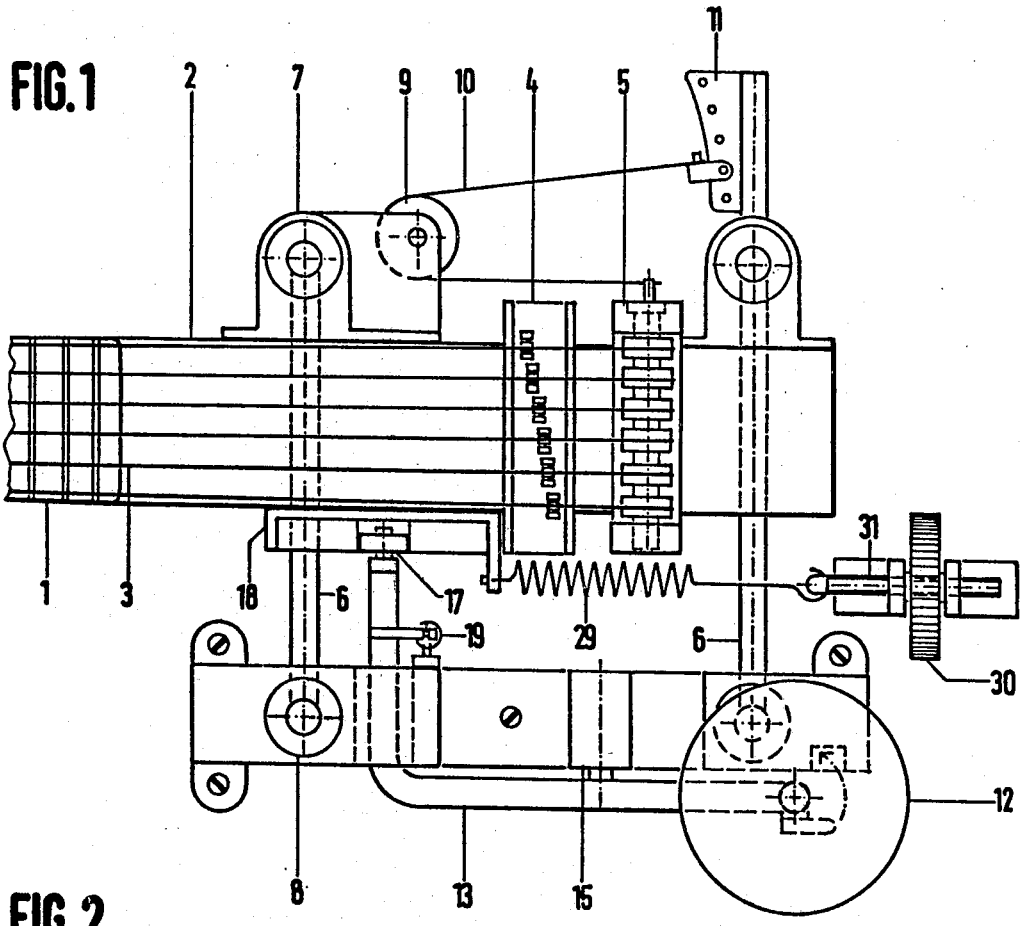
FIG. 2
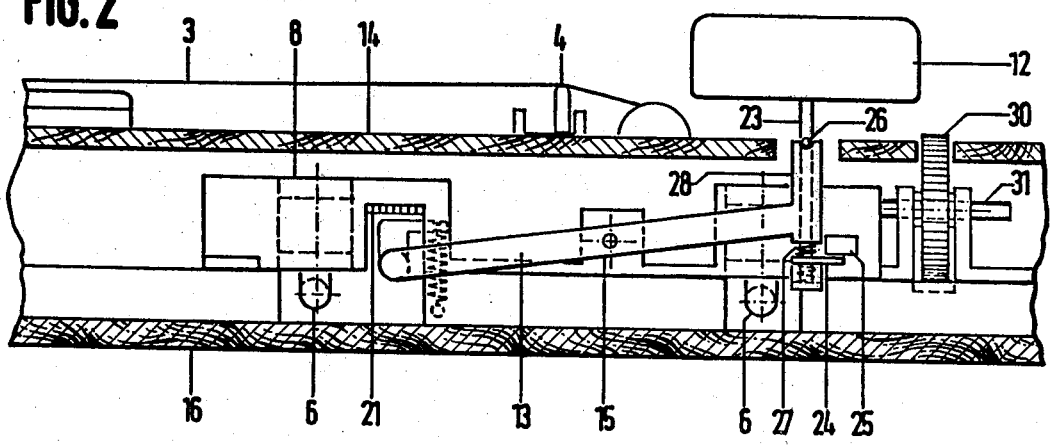
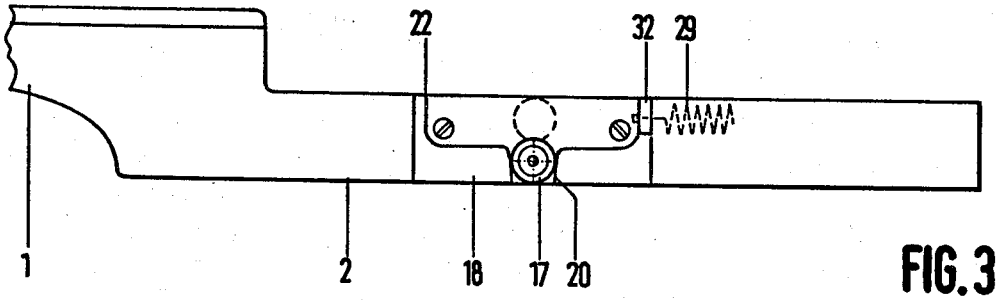
FIG. 3

DEVICE FOR CONTINUOUS PITCH VARIATION OF STRINGED INSTRUMENTS

BACKGROUND OF THE INVENTION

This invention relates to devices for continuous pitch variation of stringed instruments, especially electric guitars and electric basses, such as described in my U.S. Pat. Nos. 4,044,645 and 4,137,812, and in the German Pat. No. P 15 97 028 and furthermore in the German Offenlegungsschriften (published specifications) OS-26 35 905.7 and OS-27 04 636.2.

In such devices the neck of the instrument is extended by an extension piece and is movably mounted on the body of the instrument. The movability of the neck renders possible a control of a continuous change of the tension of the strings and with that a continuous variation of the pitch. Through the use of a locking-device, the neck can be made movable or immovable, just as it is necessary when playing.

It has turned out in practice that the locking-device is of great importance for a good operation and satisfactory use of the whole device to render possible a masterly playing. For normal use it is necessary that the opening or unlocking and the locking can be controlled and executed in a fast and exact operating manner. A faultless manipulation of the locking-device must be guaranteed in both playing postures, that is, with the player either standing or sitting.

The arrangement of a lever-plate as shown in U.S. Pat. No. 4,137,812 (see part 41 in FIG. 4) has disadvantages when sitting, but especially when standing, caused through the fact that an unintentional operation may easily be produced, when the instrument is held against the body of the player with the usual pressure.

An object of the invention is to eliminate said disadvantages and to render possible a fast and exact control and operating of the unlocking and locking of the neck. Another object of the invention is an improvement of the tension spring which carries the tension of the strings.

SUMMARY OF THE INVENTION

The solution of the task is found through the fact that a plate is arranged for loading by the forearm of the player's plucking hand. This plate can be moved by the action of the forearm, thus causing the movement of a lock-piece which is mounted on a mechanical arrangement for power transmission fixed on the body of the instrument.

The plate is held above the top of the instrument, placed in the normal position of the forearm. The mechanical arrangement for power transmission is preferably embodied as a tilting lever device, carrying the lock-piece on one end, and the plate on the other end. A spring biases the lever device into the locked position. If the plate is pressed down, that is vertical to the top, the lock-piece will be moved out of the lock-counter-piece, thus opening the locking-device for an unhindered movement of the neck. If pressure on the down-pressed plate is relieved, the spring pulls the lock-piece back into its locking position.

The advantage of this invention includes the fact that the player can unlock and lock the neck in a fast and precisely operating manner without disturbing or hindering the other playing actions, thus allowing a permanent change of opening and locking during the playing, in both postures, sitting and standing.

BRIEF DESCRIPTION OF THE DRAWINGS

A preferred embodiment of the invention is illustrated in the accompanying drawings, in which:

FIG. 1 is a plan view of the device, with parts omitted,

FIG. 2 is a side elevational view of the device, with parts in section, and

FIG. 3 is a side elevational view of the lock-counterpiece with the lock-piece.

DESCRIPTION OF THE PREFERRED EMBODIMENT

In the example of embodiment the neck 1 is extended by an extension piece 2 made of wood. The strings 3 are supported by the bridge 4 and are fixed on the string-holder 5. The support levers 6, and the ribbon-like traction member 10, are arranged in the same way as described in U.S. Pat. No. 4,137,812. A counter-weight as described in that patent is not employed, however, because the locking-device of this invention guarantees a perfect and constant tuning of the strings when the neck is locked. In this embodiment the ribbon-like traction member 10 can be fixed in the different boreholes of the holdplate 11, thus rendering possible an easy variation or adjustment of its lever arm relative to the support lever 6 and its rotary bearing 7.

The plate 12 is mounted on one end of the lock-lever 13 which is pivoted for tilting or swinging movement and the plate held above the top 14 of the instrument at a position where the forearm of the plucking hand of the player can rest on and load and press the plate in a convenient way. The rotary bearing 15 of the lock-lever 13, which should have only very little friction, is mounted on the body 16 of the instrument. The lock-piece, preferably embodied as an easily rotating lock-roll 17, is mounted on the opposite end of the lock-lever 13. The lock-lever 13 is formed in such a way that the lock-roll 17 can be moved into or out of the gap 20 (FIG. 3) of the lock-counterpiece 18 which is mounted on the neck 1.

The tension spring 19, which is fixed between the body 16 and the lock-lever 13, drives or biases the lock-lever 13 and with it the lock-roll 17 into the gap of the lock-counterpiece 18. The lock-roll 17 may be embodied as a ball-bearing for a perfect rotation, and should have an elastic, peripheral costing, such as rubber or plastic, to avoid the generation of noises when contacting the lock-counterpiece 18.

In this embodiment, the unoperated position of the whole lock-device is achieved when the tension-spring 19 has driven the lock-roll 17 into the lock-position. Alternatively, the lock could be spring biased in the opposite direction, normally unlocked, and pressure of the player's arm would lock the neck.

If the plate 12 is loaded and pressed down by the forearm, the lock-roll 17 will be moved out of the gap of the lock-counterpiece 18 and the neck 1 will be opened for sliding, in this preferred arrangement here illustrated. The maximum travel of the lock-lever 13 is limited in one direction by the stop-barrier 21 which is equipped with a noise-damping material. In the other direction it is limited by the lock-roll 17 being pinched in the gap of the lock-counterpiece 18. The boundary flanges 22 of the lock-counterpiece 18 determine the maximum slide travel of the neck 1 through the fact that they function as abutments or buffer stops against the lock-roll 17. When the player relieves pressure on the plate 12, the lock-roll 17 will move back into its locking position, automatically driven by the tension spring 19. This process will be effected very quickly and smoothly because the lock-roll 17 is constructed for perfect rolling or rotating.

For total locking, as may be desired for the transportation of the instrument, the plate 12 is rotatable on the lock-lever 13 and can be turned by the player. The plate 12 is in the form of a large knob on the upper end of a short shaft or axle 23 rotatable in a bearing 28 in the lever 13. Near its lower end, the axle 23 carries a radially projecting lug 24 which, when the knob 12 and axle 23 are turned to a certain position, will be driven into a lock-gap or recess 25 of a block which is fixed on the body 16, thus causing a total immobility of the lock-lever 13. The different turning-positions of the plate 12 can be stabilized by a click-stop device, in this embodiment preferably consisting of a radial pin 26 which overlies the top edge of the bearing 28 and which is pulled by the spring 27 into different notches formed in the top surface of the bearing or journal 28.

The main spring 29 is fixed between the neck 1 and the threaded rod 31 which is held by the adjusting disk 30 screwed on the rod and held against axial movement between two fixed brackets which are mounted on the body 16. If the adjusting disk 30 is turned by the user, the threaded rod 31 will be forced to execute a linear movement, thus adjusting the tension of the spring 29. In this embodiment the main spring 29 is fixed on an arm 32 of the lock-counterpiece 18. The player can easily adjust the tension of the main spring 29 by turning the adjusting disk 30 in order to drive the neck 1 and with it the lock-counterpiece 18 in a perfect position opposite to the lock-roll 17.

What is claimed is:

1. A stringed musical instrument comprising two parts movable relative to each other to vary the tension on the strings during playing, thereby to vary the pitch of the sound produced by the strings, releasable locking means operable to lock said two parts against movement relative to each other and to unlock said two parts to allow movement of said two parts relative to each other, a control member mounted on said instrument in position to be engaged by an arm of a person playing the instrument, and means responsive to pressure of the player's arm on said control member for operating said locking means, one of said two parts being the body of the instrument and the other of said two part being a movable neck portion of the instrument.

2. The invention defined in claim 1, wherein said control member is positioned to be engaged by the normal playing position of the forearm of the hand playing the strings.

3. The invention defined in claim 1, further comprising a main spring tending to move said neck portion relative to said body, and an adjusting nut mounted on said body for adjusting the tension of said spring, said adjusting nut being in a position accessible to a digit of the player of the instrument while playing.

4. The invention defined in claim 1, wherein said locking means includes means forming a notch on one of said two parts and a locking lever pivotally mounted on the other of said two parts, said lever having a lock piece entering said notch when said lever is in a locking position and withdrawn from said notch when said lever is in an unlocking position.

5. The invention defined in claim 4, wherein said lock piece is a circular member rotatably mounted on said lever to roll easily into and out of said notch.

6. The invention defined in claim 5, wherein said circular member has a periphery coated with sound damping material.

7. The invention defined in claim 4, wherein said notch is tapered so that said lock piece fits tightly in it in locking position to hold the two parts firmly against movement relative to each other.

8. The invention defined in claim 4, further including means associated with said control member for latching said locking lever in locking position.

9. The invention defined in claim 1, wherein said control member includes a rotary knob which, in one position of rotation, is responsive to pressure on the knob to operate said locking means, and means effective upon rotation of said knob to a different position for maintaining said locking means in firmly locked position regardless of pressure on the knob.

* * * * *